United States Patent [19]

Szova

[11] 4,048,823

[45] Sept. 20, 1977

[54] COMBINATION LOCK

[76] Inventor: Janos Szova, 3615 Greystone Ave., Bronx, N.Y. 10463

[21] Appl. No.: 673,100

[22] Filed: Apr. 2, 1976

[51] Int. Cl.[2] ..... E05B 37/02

[52] U.S. Cl. ..... 70/306

[58] Field of Search ..... 70/304, 305, 306, 307, 70/308, 309, 310, 311, 323, 327, 330, 331, 332

[56] References Cited

U.S. PATENT DOCUMENTS

| | | | |
|---|---|---|---|
| 922,065 | 5/1909 | Townsend | 70/332 X |
| 1,863,396 | 6/1932 | Davis | 70/309 |
| 2,125,607 | 8/1938 | Fuchs | 70/305 |
| 2,165,674 | 7/1939 | Pelle | 70/306 X |
| 2,247,220 | 6/1941 | Conlon | 70/305 |
| 2,289,234 | 7/1942 | Bergren | 70/305 |
| 2,964,936 | 12/1960 | Christen | 70/309 |
| 3,169,643 | 7/1965 | Moss | 70/311 X |
| 3,745,798 | 7/1973 | Pieddeloup | 70/306 |

FOREIGN PATENT DOCUMENTS

| | | | |
|---|---|---|---|
| 1,553,327 | 9/1969 | Germany | 70/309 |
| 646,211 | 5/1937 | Germany | 70/332 |

*Primary Examiner*—Marion Parsons, Jr.
*Assistant Examiner*—Thomas J. Holko
*Attorney, Agent, or Firm*—Edward F. Levy

[57] ABSTRACT

A combination lock includes a plurality of ratchet wheels which are moved to a lock-open position by the operation of a removeably mounted finger dial, which is similar to a telephone dial. Operation of the finger dial moves a pawl which travels in a row of circular tracks, each in alignment with a ratchet wheel, with the pawl moving in succession from track to track to rotate individual ratchet wheels as successive numbers are dialed.

10 Claims, 16 Drawing Figures

FIG. 3
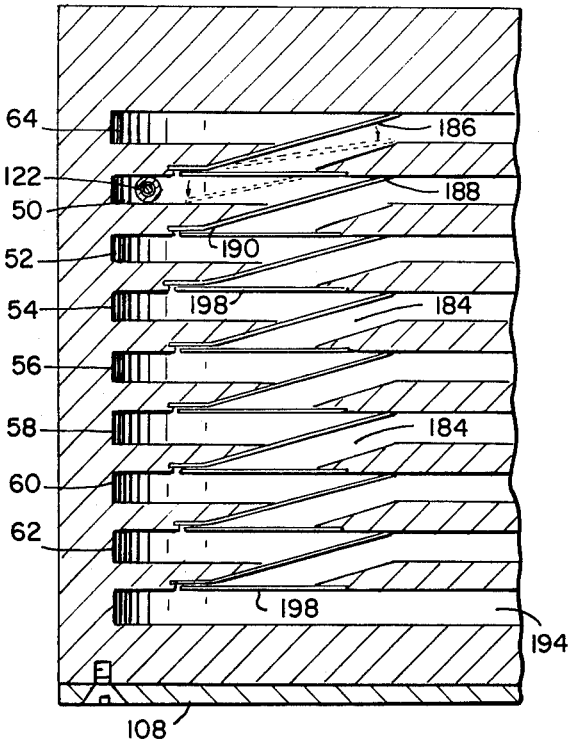
FIG. 4
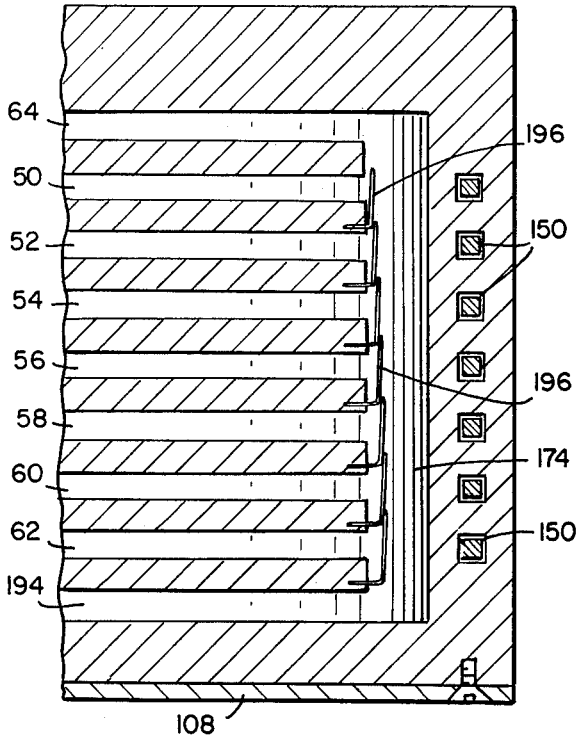
FIG. 5
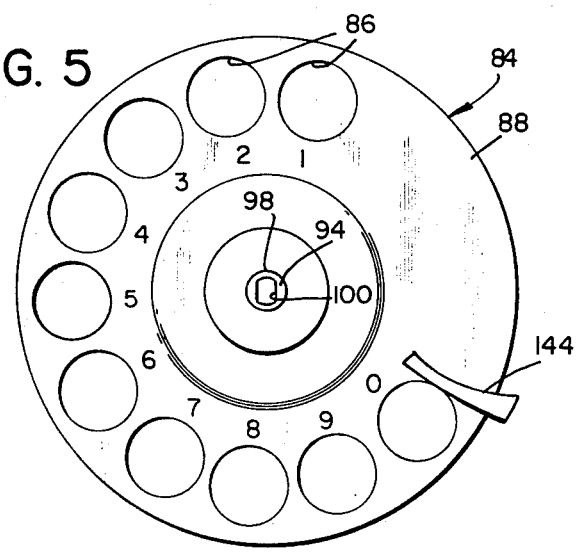
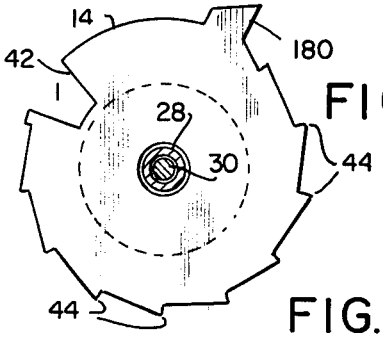
FIG. 6A
FIG. 6B
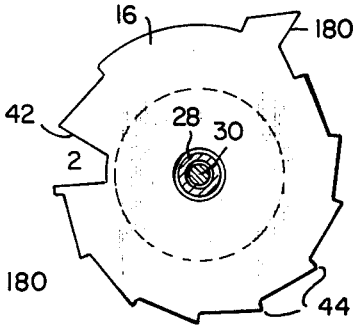
FIG. 6C
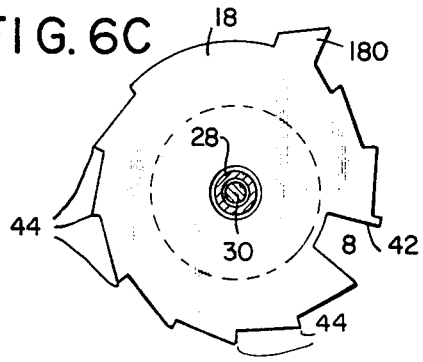
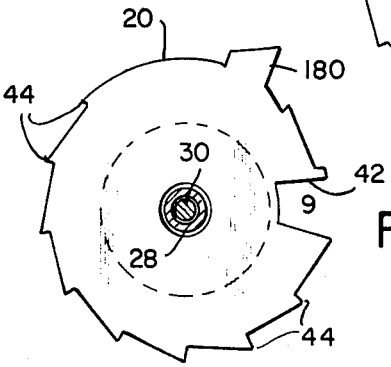
FIG. 6D

COMBINATION LOCK

The present invention relates generally to combination locks and more particularly to a dial-operated combination lock having a removable dial.

Conventional combination locks incorporate a set of disc-like tumblers, each having a radial slot. The tumblers are rotated by a dial in a prescribed manner so that all of the slots in the tumblers are aligned, thus permitting a fence to drop into the aligned slots thereby drawing a bolt. The dial is permanently mounted on the combination lock and therefore may be subjected to tampering and misuse by unauthorized persons.

In contrast to the prior art, the combination lock according to the present invention incorporates a finger dial, similar to a telephone dial, which is operated like a telephone dial. The finger dial is removed after the combination lock isused and may be carried by the user in the same manner as a key. In use, the finger dial is mounted on the combination lock and a seven digit number is dialed similarly to the dialing of a telephone. Within the combination lock there are seven actuating wheels which are set in a lock-open position in response to the dialing of the correct sequence of numbers.

The operation of the finger dial rotates a spindle which extends into a cylindrical housing portion of the combination lock. The seven actuating wheels are each mounted for individual rotation on the spindle and each is biased by a coil spring to a normal lock-closed position. Each of the actuating wheels is in the form of a ratchet wheel whose teeth are engaged and turned by a pawl when the combination lock is dialed. Around each ratchet wheel there is a circular track formed in the cylindrical track formed in the cylindrical housing, with the tracks arranged in a vertical row in registry with each other. The pawl will travel successively in these tracks moving down from track to track each time the finger dial is turned.

When the pawl is located in any one of the circular tracks it engages a ratchet tooth of the ratchet wheel which is at that level. When the user puts his finger in one of the finger dial holes and turns the finger dial until it engages a stop, the pawl and the ratchet wheel are rotated. When the finger dial is released, a spring returns the pawl, which travels back over the teeth of the ratchet wheel but does not turn back the ratchet wheel so that the ratchet wheel remains in the dialed position.

Each ratchet wheel has a cut-out slot and if the proper combination of numbers are dialed, the cut-out slots of all of the ratchet wheels will be aligned vertically and located in registry with a latch member of the combination lock, permitting the latch member to be moved to open the lock. If even one of the cut-out slots is not set in the correct position, its ratchet wheel will block movement of the latch member and the lock cannot be opened.

It is an object of the invention to provide a combination lock of the character described which has a single finger dial similar to a telephone dial, and in which the lock can be opened by dialing the correct seven digit numeral in the same manner as dialing a telephone number. Thus the combination number can be easily memorized, and the dialing of the combination is familiar and easily accomplished by anyone who has previously dialed a telephone.

Another object of the invention is the provision of a combination lock of the character described in which the finger dial is removable and may be carried about on the person of an authorized user of the lock.

Another object of the invention is the provision of a combination lock of the character described in which the removable finger dial can be mounted alternatively on opposite ends of the lock to permit opening or closing operation of the lock to be accomplished from both the inside and outside of a door or other support on which the combination lock is mounted.

Still another object of the invention is the provision of a combination lock of the character described in which the lock may be reset to locked position simply by dialing the numeral "0" on the finger dial. This resetting operation may be performed either after the lock is in open position or at any time during the dialing of the seven digit combination.

A further object of the present invention is to provide a combination lock which affords relatively great security while comprising a relatively small number of simple parts, and which is economical in manufacture.

Additional objects and advantages of the invention will become apparent during the course of the following specification, when taken in connection with the accompanying drawings, in which:

FIG. 3 is a fragmentary cross-sectional view taken along the line 3—3 of FIG. 2, showing a vertical row of circular tracks formed in the lock housing;

FIG. 4 is a fragmentary cross-sectional view taken along the line 4—4 of FIG. 2;

FIG. 5 is a top plan view of the combination lock showing the finger dial;

FIG. 6A is a plan view of a ratchet wheel which is adapted to be brought into a lock-open position when the digit 1 is dialed on the finger dial of FIG. 5;

FIG. 6B is a plan view of a ratchet wheel which is brought into a lock-open position when the digit 2 is dialed on the finger dial of FIG. 5;

FIG. 6C is a plan view of a ratchet wheel which is brought into a lock-open position when the digit 8 is dialed on the finger dial of FIG. 5;

FIG. 6D is a top view of a ratchet wheel which is brought into a lock-open position when the digit 9 is dialed on the finger dial of FIG. 5;

Figure 1:
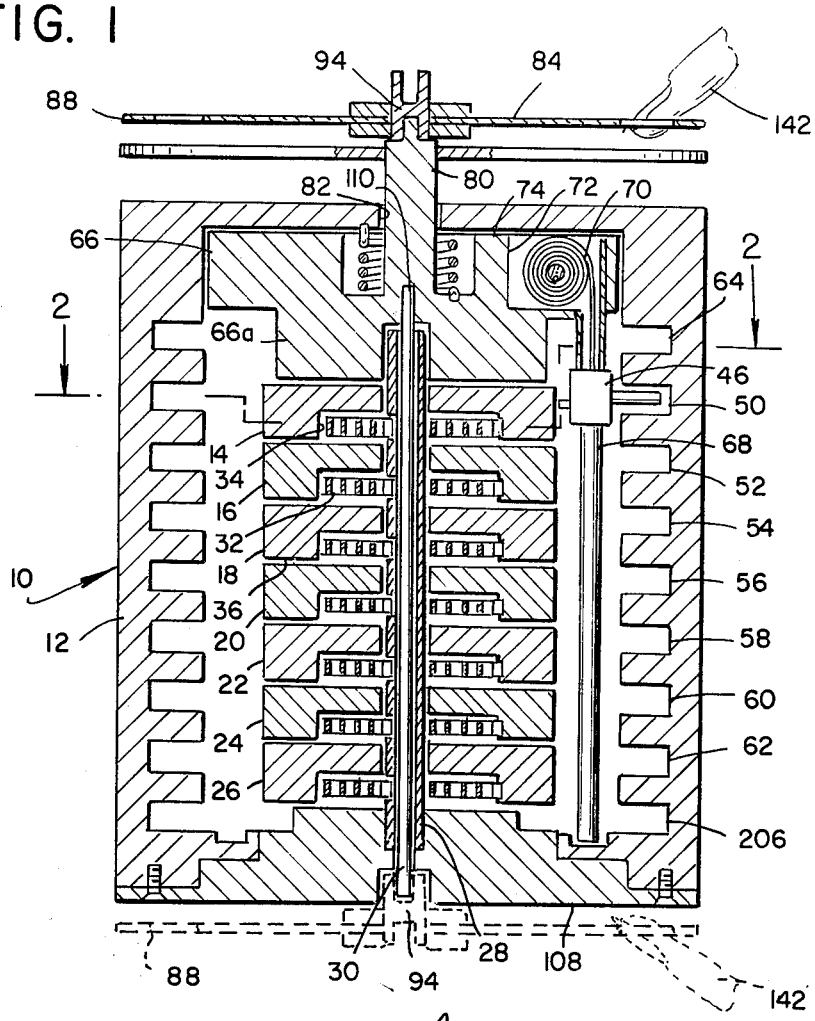
FIG. 1 is a central cross-sectional view through a combination lock made in accordance with the present invention.

Referring in detail to the drawings, there is shown in FIG. 1 a preferred embodiment of a combination lock 10 made in accordance with the present invention. The combination lock 10 comprises a cylindrical housing 12 within which are mounted seven ratchet wheels 14, 16,

18, 20, 22, 24 and 26. These ratchet wheels are individually rotatable on a common hollow spindle 28 which is mounted on a shaft 30 extending centrally through the cylindrical housing 12.

Figure 2:
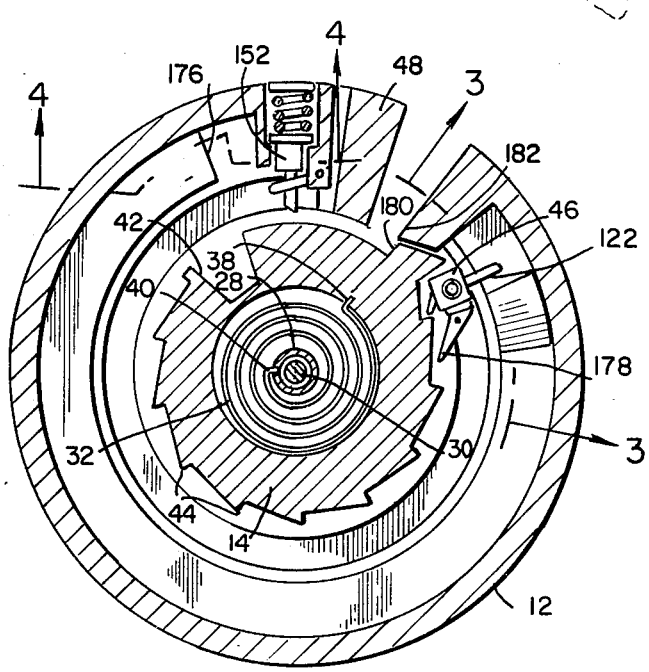
FIG. 2 is a section taken along the line 2—2 of FIG. 1.

Each of the ratchet wheels 14, 16, 18, 20, 22, 24 and 26 is biased to a normal closed position by a respective associated coil spring 32 which is mounted in a recess 34 formed in the bottom surface 36 of each of the ratchet wheels. Each of the coil spring 32 has an end 38 attached to its associated ratchet wheel, and an end 40 attached to the hollow spindle 28, as shown in FIG. 2. Each of the ratchet wheels 14, 16, 18, 20, 22, 24 and 26 is formed with a cut-out slot 42 and a plurality of ratchet teeth 44. The teeth of each ratchet wheel are successively engaged by a pawl 46, causing the engaged ratchet wheel to be turned when the combination lock 10 is dialed, in a manner to be presently described.

When the proper combination of numbers is dialed, the cut-out slots 42 of all of the ratchet wheels 14, 16, 18, 20, 22, 24 and 26 will be aligned vertically and located in registry with a latch member 48 of the combination lock 10, permitting the latch member 48 to be moved to open the combination lock 10. If even one of the cut-out slots 42 is not set in the correct position, its ratchet wheel will block movement of the latch member 48 and the combination lock 10 cannot be opened. FIGS. 6A, B, C and D show typical ratchet wheels by way of example and indicate various relative positions of the cut-out slots 42 on the respective ratchet wheels.

Each of the ratchet wheels 14-26 is bordered by a respective circular track 50, 52, 54, 56, 58, 60 and 62 which is formed in the inner surface of the cylindrical housing 12. The tracks 50-62 are arranged in a vertical row in alignment with each other and in registry with the respective ratchet wheels 14–26. The pawl 46 travels successively in the tracks 50–62, moving from track to track each time the combination lock 10 is dialed. Above the row of tracks 50–62 there is an additional circular track 64 which receives the pawl 46 when it is in the starting position.

Mounted within the top end of the cylindrical housing 12 is a rotatable actuating member 66 which carries the pawl 46. The actuating member 66 is in the form of a cylindrical block having a circular extension 66*a* of lesser diameter depending from its lower end. Secured to the actuating member 66 and depending therefrom is an elongated cylindrical guide member 68 upon which the paws 46 is slidably mounted. When the actuating member 66 is turned, it carries the guide member 68 and the mounted pawl 46 around with it. The pawl 46 can also travel longitudinally along the length of the guide member 68. The pawl 46 is urged upwardly by a coil spring 70 which is located partially within a recess 72 formed in the upper surface 74 of the actuating member 66, the spring 70 extending into the interior of the hollow guide member 68. The hollow guide member 68 is formed with a longitudinal slot 76 which permits the attachment of the lower end 78 of the coil spring 70 to the pawl 46.

The actuating member 66 is formed with an integral central post 80 which projects upwardly from the cylindrical housing 12 through an aperture 82 in the top wall of the latter, and also projects outwardly of the safe or door on which the combination lock 10 is mounted. A removable finger dial 84, shown in plan view in FIG. 5, is mounted on the central post 80 as shown in FIG. 1.

Figure 10:
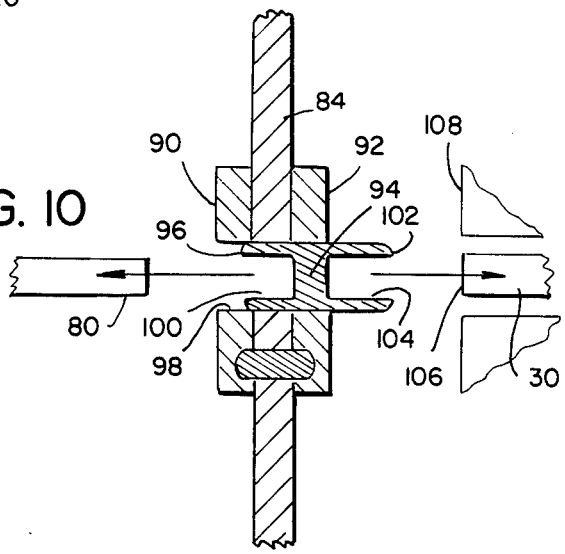
FIG. 10 is a cross-sectional view of the lock finger dial, showing means for attachment to either end of the combination lock.

The finger dial 84 is similar to a standard telephone dial, comprising a circular dial plate 88 having ten finger holes 86 which are associated with the numerals 0 to 9 marked on the dial plate adjacent said finger holes, as shown in FIG. 5. At its center, the dial plate 88 is reinforced by circular plates 90 and 92 having a central aperture within which is secured an adapter 94, as shown in FIG. 10. The adapter 94 has a first end 96 recessed within the central aperture 98 of the finger dial 84 and having a non-circular cavity 100 which fits the central post 80 which is correspondingly shaped. The opposite end 102 of the adapter 94 projects outwardly of the circular plate 92 and is provided with a cavity 104 which fits the lower end 106 of the shaft 30 which is located within an aperture in the bottom plate 108 of the cylindrical housing 12. The finger dial 84 may thus be mounted on the central post 80 of the actuating member 66 which projects outwardly of a door upon which the combination lock 10 is mounted, or alternatively, the finger dial 84 may be inverted and mounted on the end of the shaft 30 which is recessed in the bottom plate 108 of housing 10, but accessible on the inside of the door. This operation of the combination lock 10 is permitted from the inside as well as the outside of the door.

The shaft 30 projects through the hollow spindle 28 and has an upper end 110 which is secured to the actuating member 66. The shaft 30 is thus rotatable with said actuating member.

Figure 8:
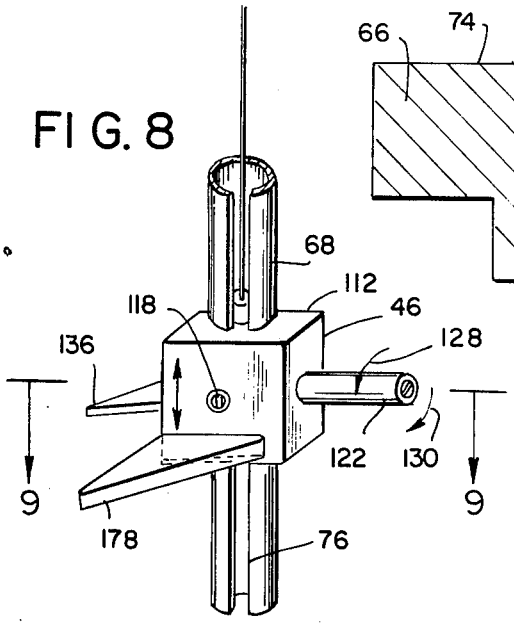
FIG. 8 is a perspective view of the pawl member.
Figure 9:
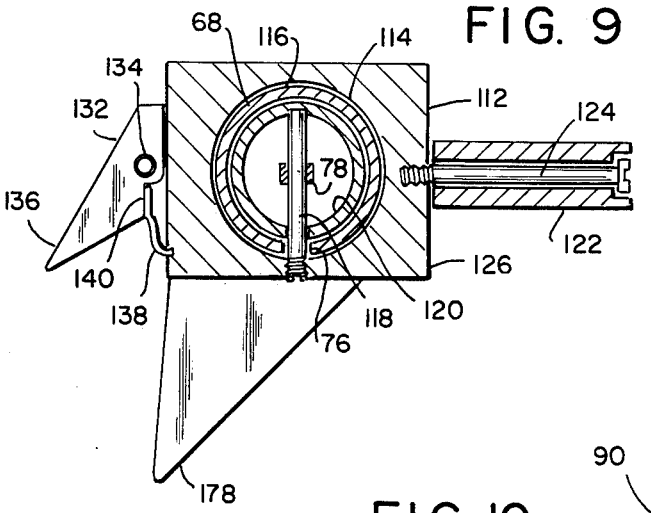
FIG. 9 is an enlarged section taken along the line 9—9 of FIG. 8.

As shown in FIGS. 8 and 9, the pawl 46 comprises a housing 112 having a central bore 114 which slides on the outer surface 116 of the guide member 68 which depends from the actuating member 66. A shaft 118 is mounted on housing 112 and extends inwardly through the center of said housing and through the slot 76 formed in the guide member 68. The shaft 118 is secured to a hollow cylindrical inner guide member 120 and supports the latter immovably within the guide member 68. The lower end of the coil spring 78 is attached to the shaft 118. The pawl 46 also includes a roller 122 which is mounted on a shaft 124 which projects from the surface 126 of the housing 112. The roller 122 is free to rotate in the directions shown by the arrows 128, 130 in FIG. 8 and is sized and positioned to extend successively into the circular tracks 50–62 for the purpose of guiding the pawl 46 when the finger dial 84 is operated.

Figure 7:
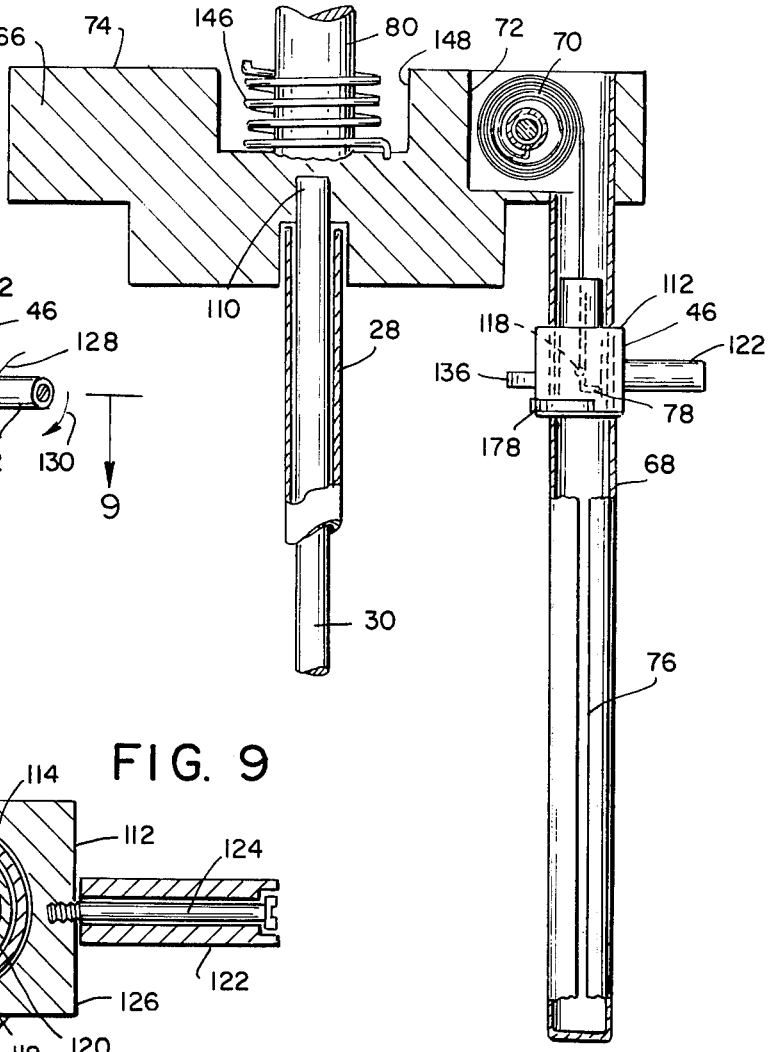
FIG. 7 is a fragmentary sectional view of the dial actuating member and the pawl member of the lock.

On the side of the housing 112 opposite the roller 122, a triangular lever or pawl arm 132 is pivotally mounted on a pivot pin 134 affixed to said housing 112. When the roller 122 of pawl 46 is located in any one of the circular tracks 50-62, the pivotally mounted lever 132 engages the ratchet wheel which is at that level. The end 136 of the lever 132 is biased in an outward direction by a leaf spring 138 which projects from the housing 112 and bears on surface 140 of the lever 132. When the user places his finger 142 in one of the dial finger holes 86, as shown in FIG. 1, and turns the finger dial 84 until it engages a stop 144, the actuating member 6 and the pawl 46 are rotated a corresponding distance. The pawl 46 is in engagement with one of the ratchet wheels 14–26, depending upon in which of the tracks 50–62 it happens to be located. FIG. 1, for example, shows the pawl 46 located in track 50 and engaging the first ratchet wheel 14 when the dial 84 is turned, the pawl 46 is turned therewith and rotates the ratchet wheel 14 a corresponding distance. When the finger dial 84 is released, the actuating member 66 and finger dial 84 are returned to their original position by a torsion spring 146 which is mounted in a central recess 148 in the upper surface 74 of actuating member 66. As shown in FIGS. 1 and 7, the return spring 146 is attached at one end to the actuating member 66 and at the other end to the top wall of housing 12. The pawl 46 travels back over the teeth 44 of the ratchet wheel 14 but does not turn the ratchet wheel 14 since the leaf spring 138 permits the lever 132 to swing inwardly thus passing over the crests of the ratchet wheel teeth 44. The ratchet wheel 14 thus remains in its dialed position.

Figure 11:
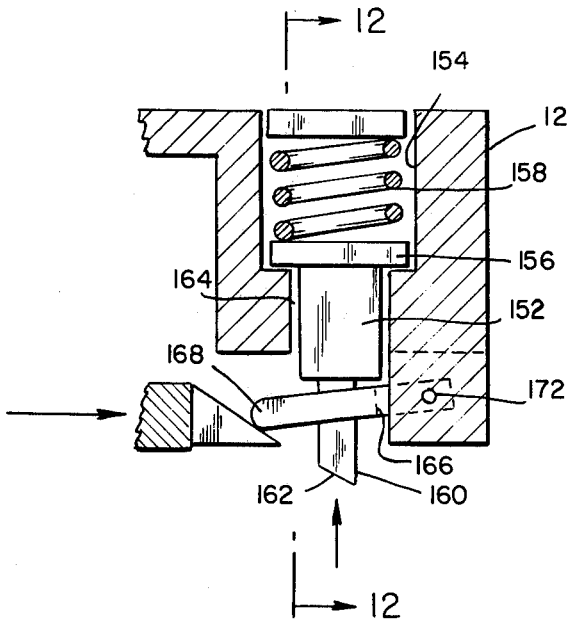
FIG. 11 is an enlarged fragmentary portion of FIG. 2 showing the details of construction of the detent post.
Figure 12:
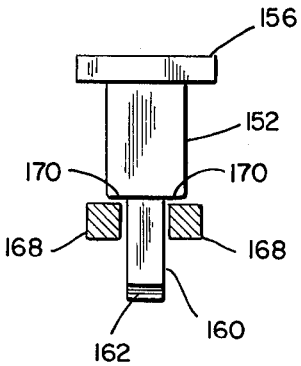
FIG. 12 is a section taken along line 12—12 of FIG. 11.
Figure 13:
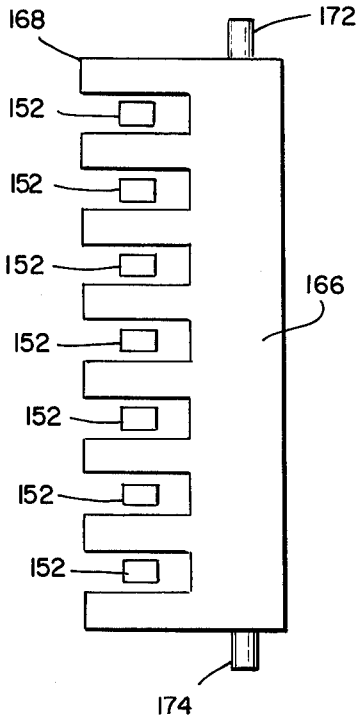
FIG. 13 is a view of the release bar with the release bar shown removed from the housing of the combination lock.

The ratchet wheels 14–26 are held in their dialed positions by a plurality of spring loaded detent pins 152 shown in FIGS. 2, 4 and 11. As shown in FIG. 4, a detent pin 152 is provided for each of the ratchet wheels 14-26, these detent pins 152 being located in a row with each detent pin in alignment with a respective ratchet wheel 14-26. As shown in FIG. 11, each detent pin 152 is located in a recess 154 formed in the cylindrical housing 12 and has an upper end 156 of increased diameter which is biased outwardly of the recess 154 by a helical spring 158. Each detent pin 152 has a lower end 160 formed with an inclined cam surface 162 which projects through an aperture 164 in the cylindrical housing 12 and extends to a respective ratchet wheel 14–26. Pivotally mounted within the cylindrical housing 12 is a release bar 166 which has a plurality of projecting fingers 168 which project between the detent pins 152 as shown in FIG. 13. The projecting fingers 168 bear against shoulders 170 formed on the detent pins 150, as shown in FIG. 12. The release bar 166 is pivotally attached to the cylindrical housing 12 by upper and lower pivot stubs 172, 174 and when the digit "0" is dialed, the pawl 46 travels to a longitudinal recess 176 in housing 12, and a wedge portion 178 on the pawl 46 engages those projecting fingers 168 of the release bar 166, which are aligned with the particular circular track 50–62 in which the pawl 46 may be located. The pawl wedge portion 178 pivots the release bar 166, thus depressing all of the detent pins 150 and releasing all of the ratchet wheels 14–26 to permit all of the coil springs 32 to reset the ratchet wheels to their initial positions in which a projecting stop member 180 on each ratchet wheel 14–26 is in contact with a detent 182 on the cylindrical housing 12, as shown in FIG. 2. The recess 176 is an elongated longitudinal slot which passes through all of the circular tracks 50-64, and when the number 0 is dialed and the pawl 46 is brought into registry with the recess 176, the pawl 46 is drawn upward by the coil spring 70 into the top inactive track 64. Dialing the number 0 at any time during the operation of the combination lock 10 thus serves to reset all of the ratchet wheels 14–26 to their original positions and to bring the pawl 46 to the top inactive circular track 64.

FIGS. 3 and 4 show the manner in which the pawl 46 is caused to move successively from one circular track to the next circular track immediately below, each time the finger dial 84 is turned and released. Each of the circular tracks 50–64 has an inclined passageway 184 through which it communicates with the track therebeneath and an inclined leaf spring 186 which overlies this passageway 184 and performs the switching function. In FIG. 1 the pawl 46 is shown at the level of, and in engagement with the track 50 which registers with the first ratchet wheel 14. The position of the pawl 46 is shown in FIG. 3 by the pawl roller 122 extending within track 50. As soon as the finger dial 84 is turned, the pawl 46 begins to travel to the right, as viewed in FIG. 3, through the track 50, with the pawl in engagement with the first ratchet wheel 14. The roller pawl roller 122 encounters the upper side 188 of the leaf spring 186 and presses the leaf spring downwardly as it continues to move in track 50. As the finger dial 84 continues to be turned, the pawl roller 122 travels through track 50 and turns the ratchet wheel 14 through the dialed distance. When the finger dial 84 is released, the pawl roller 122 travels back (to the left in FIG. 3) through the track 50 and now encounters the lower side 190 of the leaf spring 186 of track 50 and is forced to travel through the inclined passageway 184, as shown by the arrow 192, into the next track 52 where it engages the second ratchet wheel 16.

The next time the finger dial 84 is turned, the pawl roller 122 engages the leaf spring 186 of the track 52 but from the upper side thereof, so that the roller 122 presses down said leaf spring 186 and passes over it, staying in the track 52 as turns the ratchet wheel 16 through the dialed distance.

When the finger dial 84 is released, it begins to move the pawl roller 122 to the left in track 52 and the leaf spring 186 in this track now operates to force the pawl roller 122 down the inclined passageway 184 to the next track 54 so that the pawl 46 now engages the next ratchet wheel 18. The aforementioned sequence of operation is repeated until all of the ratchet wheels 14, 16, 18, 20, 22, 24 and 26 have been turned in succession by the dialing of seven numbers.

As shown in FIGS. 6A to 6D, the latch release slot 42 of each of the ratchet wheels 14-26 is positioned at a circumferential location on the wheel corresponding to a selected number to be dialed. For example, on the ratchet wheel 14 shown in FIG. 6A, the slot 42 is formed at a position corresponding to the dialed numeral 1. Thus, when the ratchet wheel 14 is in its starting position shown in FIG. 6A and FIG. 1, if the finger dial 84 is dialed to numeral 1 while the pawl 46 is in engagement with said ratchet wheel 14, the latter will be turned through such a distance as to set it with the slot 42 in registry with the latch member 48. If any other numeral is dialed, the ratchet wheel 14 will be set with the slot 42 out of latch-release position, and the lock cannot be opened.

Similarly, the ratchet wheel 16 is shown in FIG. 6B with its slot 42 located, by way of example, at a position corresponding to the dialed numeral 2. In FIGS. 6C and 6D, the ratchet wheels 18 and 20 are shown with their slots 42 respectively located at positions corresponding to the dialed numerals 8 and 9. Thus, with these first four ratchet wheels formed as shown, in dialing the correct seven digit number to open the lock, the first four numerals dialed would have to be 1, 2, 8 and 9. If the correct seven digit number is dialed, all of the slots 42 of ratchet wheels 14–26 will be set in registry with the latch member 48 so that the lock can be opened.

After the seventh number has been dialed to set the seventh ratchet wheel 26, when the finger dial 84 is released, the pawl roller 122 moves to the left through track 62 and travels through the inclined passageway 184 to the lowermost track 194 in which position the pawl 46 is out of engagement with any of the ratchet wheels. To reset the lock in locked condition, the finger dial 84 is dialed to the 0 numeral. This moves the pawl roller 122 to the right, as viewed in FIGS. 3 and 4, through the lowermost track 194 to a position in which the roller 122 is located within the longitudinal slot 174. The coil spring 70 is now effective to raise the roller 122 (and its attached pawl 46) to the top of slot 174, where the roller is in alignment with the uppermost track 64. Upon release of the finger dial from the zero position, the roller 122 is now moved by dial return spring 146 to the left, as viewed in FIGS. 4 and 5, until it engages the leaf spring 186 of track 64 and is guided down through the inclined passageway 184 to the track 50. The pawl roller 122 thus comes to rest in track 50 at its starting position shown in FIG. 3, and the lock is set for reopening upon the dialing of the correct seven digit combination.

It will be appreciated that when the numeral zero is dialed, as described above, all of the ratchet wheels 14-26 are released, and returned from their lock-open positions, by their respective coil springs 32, to their lock-closed positions. This is accomplished by engagement of the pawl wedge portion 178 with the pivoted release bar 166, causing the latter to depress the detent pins 152 which were holding the ratchet wheels in their lock-open positions.

As previously indicated, the lock may be reset in its closed position at any time during the dialing of the seven digit combination, for example where it is realized that an incorrect number has been dialed, simply by dialing the numeral zero. Thus, regardless of the track 50-62 in which the pawl 46 is located, the turning of the finger dial 84 to the zero position will move the pawl roller 122 into the longitudinal slot 174 and cause the roller to be lifted to the top track 64, at the same time releasing all of the ratchet wheels. As shown in FIG. 4, each of the tracks 50-62 may be provided with an overlying leaf spring 196 adjacent the slot 174, each leaf spring 196 being secured at its lower end to the housing 12 immediately below its associated track. When the pawl roller 122 is moved to the right through any of the tracks to the slot 174, it engages the over-lying leaf spring 196 and causes it to flex outwardly, permitting the roller 122 to override the leaf spring and enter the slot 174. However, the leaf springs 196 insure that the roller 122 cannot move from the slot 174 back into any of the tracks 50-26.

As shown in FIG. 3, a flexible strip or leaf spring 198 may also be mounted across the bottom end of each of the inclined passageways 184, each of the flexible strips 198 being secured at its right-hand end to the body of housing 12 adjacent the respective passageway 184 and having a free opposite end, when the pawl roller 122 is moved downwardly through the passageway 184, it engages the underlying flexible strip 198 and causes the latter to flex downwardly, permitting the roller to move past the flexible strip 198 into the track 50-62 therebeneath. The flexible strips 198, however, prevent the roller 122 from passing from said track back into the inclined passageway 184.

While a preferred embodiment of the invention has been shown and described herein, it is obvious that numerous additions, changes and omissions may be made in such embodiment without departing from the spirit and scope of the invention.

What is claimed is:

1. A combination lock comprising a lock housing, dial means rotatably mounted on said lock housing, a plurality of ratchet wheels rotatably mounted in an aligned stack within said housing, for individual movement between a normal lock-closed position and a lock-open position, pawl means movably mounted in said lock housing, means providing a driving connection between said pawl means and said dial means for movement of said pawl means in a circular path in response to turning movement of said dial means, and guide means disposed within said lock housing for guiding said pawl means into successive engagement with each of said ratchet wheels responsive to operation of said dial means, said guide means comprising a plurality of tracks formed in said lock housing, each of said tracks being in alignment with a respective ratchet wheel.

2. A combination lock according to claim 1 in which each of said tracks includes a passageway portion communicating with an adjacent track, and a leaf spring overlying said passageway portion.

3. A combination lock according to claim 1 in which each of said ratchet wheels includes a slotted portion, said lock further including latch bar means positioned to enter said slotted portions when said slotted portions are aligned in said lock-open position, for the purpose of opening said combination lock.

4. A combination lock according to claim 1 in which said dial means comprises a finger dial plate mounted on said lock housing and in which said driving connection means includes dial mounting portions located at opposite ends of said lock housing and adapted to receive and mount said finger dial plate alternatively on opposite ends of said lock housing.

5. A combination lock according to claim 1 in which each of said ratchet wheels includes resilient means disposed to bias said ratchet wheels to said lock-closed position.

6. A combination lock according to claim 5 which further includes ratchet wheel retaining means for retaining said ratchet means in a dialed position, said retaining means comprising a plurality of spring loaded detent pins disposed within said lock housing, each of said spring loaded detent pins having an end in alignment with and normally engaging one of said ratchet wheels.

7. A combination lock according to claim 6 which further comprises ratchet wheel reset means operative to release said ratchet wheels from said retaining means and to permit said resilient means to return said ratchet wheels to their initial lock-closed positions, said reset means being operable in response to the dialing of a preselected indicia on said dial means.

8. A combination lock according to claim 7 in which said ratchet wheel reset means comprises a release bar pivotally mounted within said lock housing and having an intermediate portion bearing against each of said spring loaded detent pins, and in which said pawl means has a cam surface movable therewith and positioned to engage and move said release bar to a position in which the release bar presses said spring loaded detent pins to a ratchet wheel releasing position in response to the dialing of a preselected position on said dial means.

9. A combination lock according to claim 8 which further includes means for resetting said pawl means to an initial position in engagement with the first of said ratchet wheels, said pawl resetting means being operative in response to the dialing of said preselected position on said dial means.

10. A combination lock according to claim 9 in which said pawl resetting means comprises a reset slot communicating with each of said plurality of tracks and being positioned to receive said pawl means therein when said dial means is turned to said preselected position, an additional, resetting track located adjacent to said first track and communicating with said reset slot, said resetting track having a passageway communicating with the first of said plurality of tracks, and spring means connected to said pawl means and biasing said pawl means toward said resetting track.

* * * * *